US008834247B2

(12) United States Patent
Thomas et al.

(10) Patent No.: US 8,834,247 B2
(45) Date of Patent: Sep. 16, 2014

(54) VIDEO POKER WAGERING GAME HAVING BONUS HANDS BASED ON QUALIFYING HAND

(75) Inventors: Alfred Thomas, Las Vegas, NV (US); Jeremy M. Hornik, Chicago, IL (US); Dion K. Aoki, Henderson, NV (US)

(73) Assignee: WMS Gaming Inc., Waukegan, IL (US)

( * ) Notice: Subject to any disclaimer, the term of this patent is extended or adjusted under 35 U.S.C. 154(b) by 2637 days.

(21) Appl. No.: 11/357,501

(22) Filed: Feb. 17, 2006

(65) Prior Publication Data

US 2006/0199632 A1 Sep. 7, 2006

Related U.S. Application Data

(60) Provisional application No. 60/657,947, filed on Mar. 1, 2005.

(51) Int. Cl.
*A63F 9/24* (2006.01)
*G07F 17/32* (2006.01)

(52) U.S. Cl.
CPC ..... *G07F 17/32* (2013.01)
USPC ..... 463/13

(58) Field of Classification Search
USPC ..... 463/10–13, 16–22, 25, 29, 40–42; 273/138.1, 139, 142 B, 142 A, 142 J, 273/148 A, 148 R, 148 B, 149 P, 149 R, 274, 273/292–293, 304, 306, 309
See application file for complete search history.

(56) References Cited

U.S. PATENT DOCUMENTS

| | | | | | |
|---|---|---|---|---|---|
| 5,655,961 | A | | 8/1997 | Acres et al. | 463/27 |
| 5,678,821 | A | * | 10/1997 | Hedman | 273/292 |
| 5,810,354 | A | * | 9/1998 | Banyai | 273/292 |
| 5,863,042 | A | * | 1/1999 | Lo | 273/292 |
| 5,868,619 | A | * | 2/1999 | Wood et al. | 463/13 |
| 5,882,259 | A | * | 3/1999 | Holmes et al. | 463/13 |
| 6,007,424 | A | * | 12/1999 | Evers et al. | 463/13 |
| 6,045,129 | A | * | 4/2000 | Cooper et al. | 273/292 |
| 6,089,976 | A | * | 7/2000 | Schneider et al. | 463/16 |
| 6,110,043 | A | | 8/2000 | Olsen | 463/27 |
| 6,179,711 | B1 | * | 1/2001 | Yoseloff | 463/25 |
| 6,196,547 | B1 | * | 3/2001 | Pascal et al. | 273/292 |
| 6,217,448 | B1 | | 4/2001 | Olsen | 463/25 |
| 6,375,567 | B1 | | 4/2002 | Acres | 463/25 |
| 6,416,408 | B2 | | 7/2002 | Tracy et al. | 463/16 |
| 6,443,455 | B1 | * | 9/2002 | Webb | 273/274 |
| 6,471,587 | B1 | * | 10/2002 | Wood et al. | 463/13 |
| 6,698,757 | B1 | * | 3/2004 | Timpano | 273/274 |
| 6,857,957 | B2 | * | 2/2005 | Marks et al. | 463/13 |

(Continued)

*Primary Examiner* — Pierre E Elisca
(74) *Attorney, Agent, or Firm* — Nixon Peabody LLP

(57) ABSTRACT

A gaming machine for playing a card-based wagering game. The gaming machine includes a wager input device for receiving inputs from a player during the wagering game. The inputs include a wager amount. At least one display is also included in the gaming machine. The display displays a plurality of cards, such that the plurality of cards is arranged in a hand. The hand indicates a randomly selected outcome selected from the plurality of outcomes, which include a qualifying-hand outcome corresponding to a qualifying hand and a plurality of winning hand outcomes corresponding to winning hands. The plurality of winning hands range from a lowest winning hand to a highest winning hand and the qualifying hand is greater than the lowest winning hand. In response to the randomly selected outcome being the qualifying-hand outcome, the gaming machine awards a player a bonus hand.

20 Claims, 7 Drawing Sheets

(56) References Cited

U.S. PATENT DOCUMENTS

| | | | | |
|---|---|---|---|---|
| 7,044,468 | B2 * | 5/2006 | Sklansky et al. | 273/292 |
| 7,247,092 | B2 * | 7/2007 | Jarvis et al. | 463/13 |
| 7,488,246 | B2 * | 2/2009 | David | 463/13 |
| 7,524,243 | B2 * | 4/2009 | Bansemer et al. | 463/13 |
| 2002/0177483 | A1 * | 11/2002 | Cannon | 463/42 |
| 2004/0092301 | A1 * | 5/2004 | Williams | 463/16 |
| 2004/0132524 | A1 * | 7/2004 | Ramstad et al. | 463/16 |
| 2004/0183255 | A1 * | 9/2004 | Miller | 273/292 |
| 2005/0035552 | A1 * | 2/2005 | Ibbertson et al. | 273/292 |
| 2005/0130727 | A1 * | 6/2005 | Cebulko et al. | 463/13 |

* cited by examiner

VIDEO POKER WAGERING GAME HAVING BONUS HANDS BASED ON QUALIFYING HAND

CROSS REFERENCE TO RELATED APPLICATION

This application claims the benefit of the U.S. Provisional Application 60/657,947, filed on Mar. 1, 2005, which is hereby incorporated by reference in its entirety.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having bonus hands based upon qualifying hands.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines, and the expectation of winning at each machine is roughly the same (or believed to be the same), players are likely to be attracted to the most entertaining and exciting machines. Shrewd operators, consequently, strive to employ the most entertaining and exciting machines, features, and enhancements available, because such machines attract frequent play and, hence, increase profitability to the operator. Therefore, there is a continuing need for gaming machine manufacturers to continuously develop new games and improved gaming enhancements that attract frequent play through enhanced entertainment value to the player.

One concept successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or enhanced audio. Bonus games may, additionally, award players with "progressive jackpot" awards funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the player and operator demands.

Gaming machines utilize a variety of mechanisms to present various combinations of symbols, and to award prizes, money, or other awards associated with certain predefined winning combinations. Traditional slot machines, for example, utilize a plurality of reels (either mechanical, or simulated on a video display) and at least one payline, with certain combination of symbols landing on the payline constituting winning combinations for which awards are given to the player in accordance with a pay table. Video poker gaming machines offer an alternative wherein winning combinations correspond with traditional winning poker hands. However, traditional gaming machines often fail to provide a player with bonus poker hands. Thus, a need exists for a gaming machine to provide the player with bonus poker hands. The present invention is directed to satisfying one or more of these needs and solving other problems.

SUMMARY OF THE INVENTION

According to one aspect of the present invention, a gaming machine for conducting a card-based wagering game includes a wager input device for receiving inputs from a player during the wagering game. The inputs include a wager amount. At least one display is also included and displays a plurality of cards in a hand such that the hand indicates a randomly selected outcome of the card-based wagering game. The randomly selected outcome includes a qualifying-hand outcome corresponding to a qualifying hand and a plurality of winning outcomes corresponding to winning hands. The plurality of winning hands ranges from a lowest winning hand to a highest winning hand. The qualifying hand is greater than the lowest winning hand. In response to the randomly selected outcome being the qualifying outcome, a player is awarded a bonus hand.

According to another aspect of the invention, a method of conducting a wagering game on a gaming machine comprises dealing a player a poker hand. The poker hand includes a plurality of winning hands ranging from a lowest winning hand to a highest winning hand and a qualifying hand being greater than the lowest winning hand. In response to the poker hand being one of the plurality of winning hands, the player receives an award amount. In response to the poker hand being the qualifying hand, the player is awarded at least one bonus hand.

According to yet another aspect of the invention, a method of playing a card-based wagering game is provided. The method includes receiving a wager to play the card-based wagering game on a gaming machine. The wagering game includes a plurality of winning outcomes, including a lowest winning outcome and a qualifying outcome that is different from the lowest winning outcome. A first randomly selected outcome is displayed. A player is granted an award in response to the first randomly selected outcome being one of the plurality of winning outcomes. In response to the first randomly selected outcome being the qualifying outcome, a second randomly selected outcome is displayed.

According to another aspect of the invention, a computer readable storage medium is encoded with instructions for directing a gaming device to perform the above method.

Additional aspects of the invention shall be apparent to those of ordinary skill in the art in view of the detailed description of various embodiments, which is made with reference to the drawings, a brief description of which is provided below.

DETAILED DESCRIPTION

Figure 1:
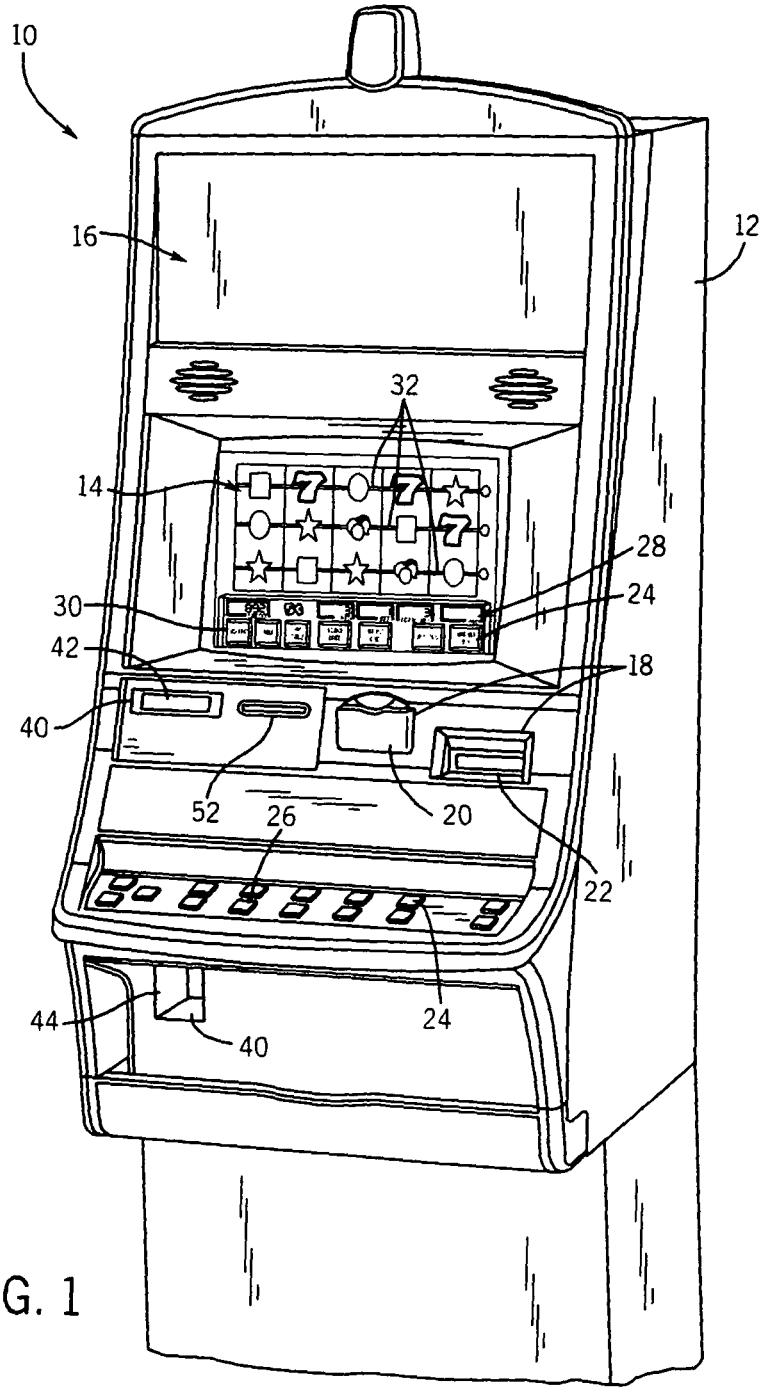
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure shall be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electronic gaming machine configured to play a video casino game, such as slots, keno, poker, blackjack, roulette, etc.

The gaming machine 10 comprises a housing 12 and includes input devices, including a value input device 18 and a player input device 24. For output, the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader or barcode scanner for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an option on how to make game selections. A player enables a desired function, either by touching the touch screen 28 at an appropriate touch key 30, or by pressing an appropriate push button 26 on the button panel. The touch keys 30 may be used to implement the same functions as push buttons 26. Alternatively, the push buttons 26 may provide inputs for one aspect of the game operation, while the touch keys 30 may allow for input needed for another aspect of the game.

The various components of the gaming machine 10 may be connected directly to, or contained within, the housing 12 as seen in FIG. 1, or may be located outboard of the housing 12 and connected to the housing 12 via a variety of wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle towards the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of cards arranged in a poker, blackjack or other card hand. The player randomly selects such outcomes in response to the wagering input. At least one of the plurality of randomly selected outcomes may trigger a bonus game, which is discussed in more detail below.

In some embodiments, the gaming machine 10 may also include a player information reader 52 that allows for identification of a player by reading a card with information indicating his or her true identity. The player information reader 52 is shown in FIG. 1 as a card reader, but may take on many forms, including a ticket reader, bar code scanner, RFID transceiver or computer readable storage medium interface. Currently, casinos use this identification to reward certain players with complimentary services or special offers. For example, a player may be enrolled in the gaming establishment's loyalty club and may be awarded certain complimentary services as that player collects points in his or her player-tracking account. The player inserts his or her card into the player information reader 52, allowing the casino's computers to register that player's wagering at the gaming terminal 10. The gaming terminal 10 may use the secondary display 16, or other dedicated player-tracking display, for providing the player with information about his or her account or other player-specific information. Also, in some embodiments, the information reader 52 may be used to restore game assets that the player achieved and saved during a previous game session.

Figure 2:
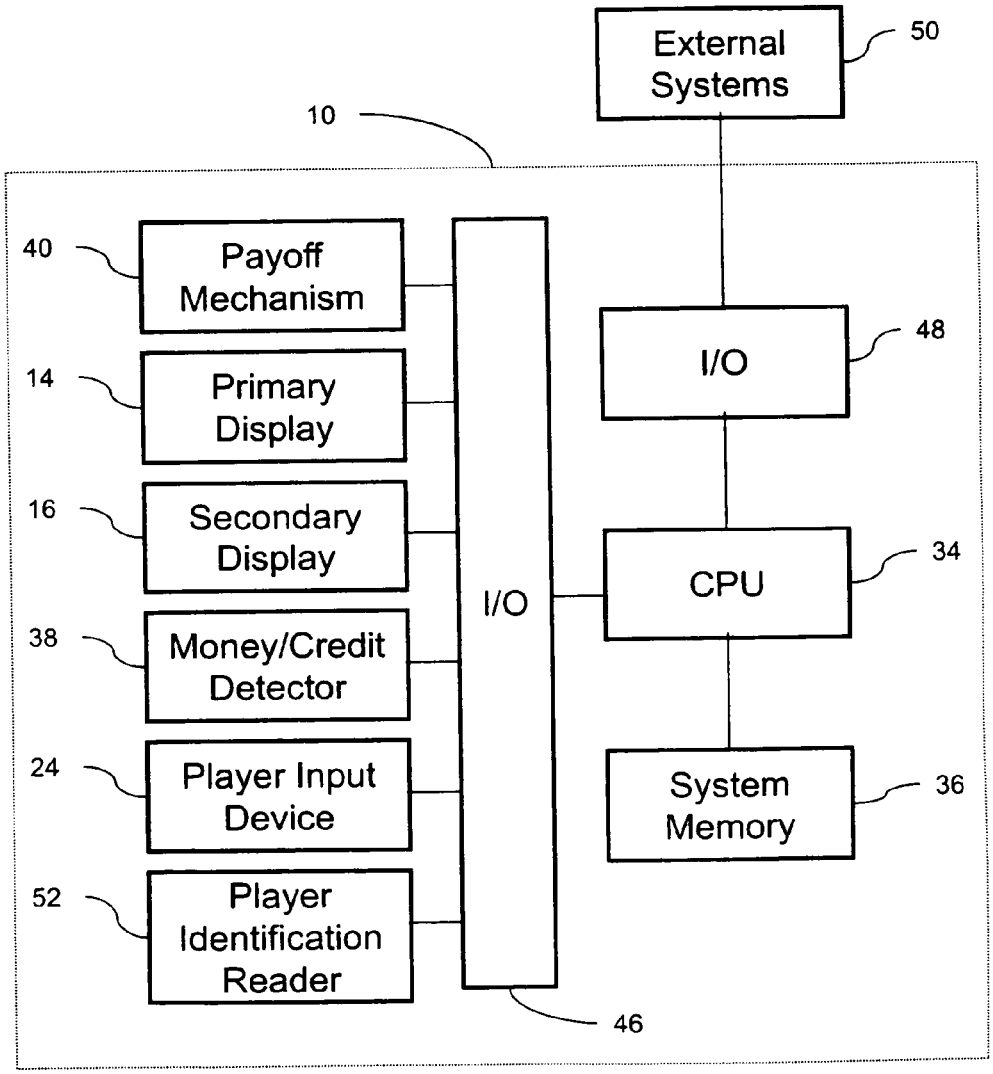
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection using a random number generator (RNG) of an outcome from the plurality of possible outcomes of the wagering game. Alternatively, the random event may be determined at a remote controller. The remote controller may either use an RNG or a pooling scheme for its central determination of a game outcome. It should be noted that the controller 34 may include one or more microprocessors, including, but not limited to, a master processor, a slave processor, and a secondary or parallel processor.

The controller 34 is also coupled to the system memory 36 and a money/credit detector 38. The system memory 36 may comprise a volatile memory (e.g., a random-access memory [RAM]) and a non-volatile memory (e.g., an EEPROM). The system memory 36 may include multiple RAM and multiple program memories. The money/credit detector 38 signals the processor that money and/or credits were input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable, in response to instructions from the controller 34, and awards a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. One or more pay tables stored in the system memory 36 determine the payoff amounts distributed by the payoff mechanism 40.

Communications between the controller 34 and both the peripheral components of the gaming machine 10 and external systems 50 occur through input/output (I/O) circuits 46, 48. More specifically, the controller 34 directs and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Even though the I/O circuits 46, 48 may be shown as a single block, it should be noted that each of the I/O circuits 46, 48 may include different types of I/O circuits.

Controller 34, as used herein, comprises any combination of hardware, software, and/or firmware that may be disposed or reside inside and/or outside the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may, alternatively, comprise a CPU in combination with other components, such as the I/O circuits 46, 48 and the system memory 36.

Figure 3:
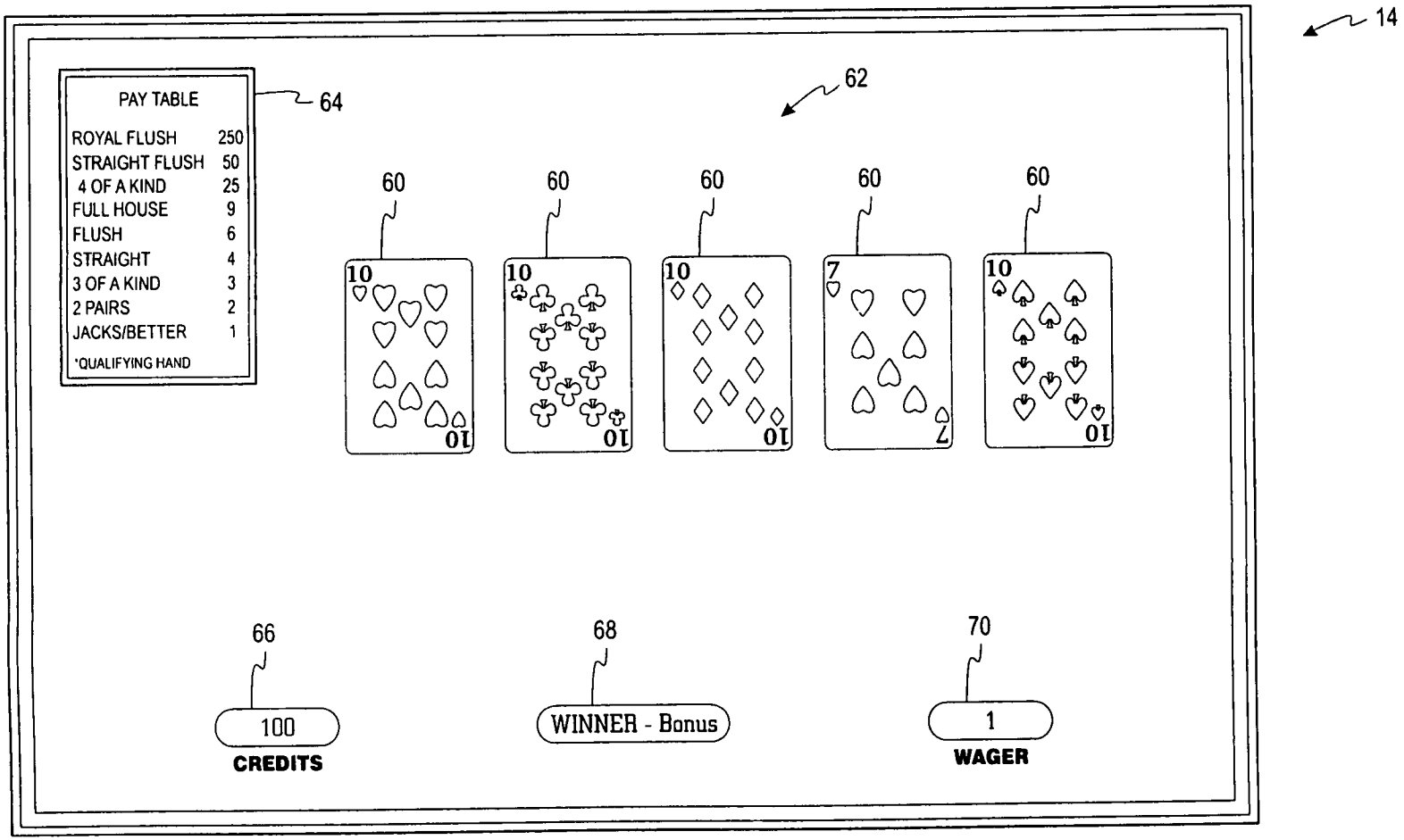
FIG. 3 is an initial screen of the primary display of the gaming machine of FIG. 1.

Turning now to FIG. 3, an initial screen of the primary display 14 of the gaming machine 10 is described. The initial screen includes five cards 60 arranged in a first poker hand 62. The primary display 14 also includes a first pay table 64 and various counters and indicators, such as a credit counter 66, outcome indicator 68, and wager indicator 70. The outcome indicator 68 indicates whether an outcome of the wagering game resulted in a payout, a progressive jackpot, a bonus game, or whether it resulted in no reward at all. The credit counter 66 illustrates how many credits a player has remaining in the gaming terminal 10. The credit counter 66 increases whenever the player wins credits and decreases whenever the player makes a wager. The wager indicator 70 indicates how many credits the player is wagering on that particular game cycle.

Referring to FIGS. 3-6, an example of the operation of one embodiment of the card-based wagering game will be described. As shown, the first poker hand 62 is dealt to the player. In most poker games, the player is dealt a first hand and then given the option to "hold" some of the cards. The cards not "held" are discarded, and the player is dealt new cards (i.e., "draw"). For illustration purposes, the first poker hand 62 is the final hand. In other words, the player has already held and discarded certain cards.

According to the first pay table 64, the first poker hand 62 is a winning hand, resulting in a win of 25 credits. Because the first poker hand 62 is a four-of-a-kind, it is also a qualifying hand, making the player eligible to receive a bonus hand. In this embodiment, a qualifying hand is any hand of four-of-a-kind or higher, according to the first pay table 64.

Figure 4:
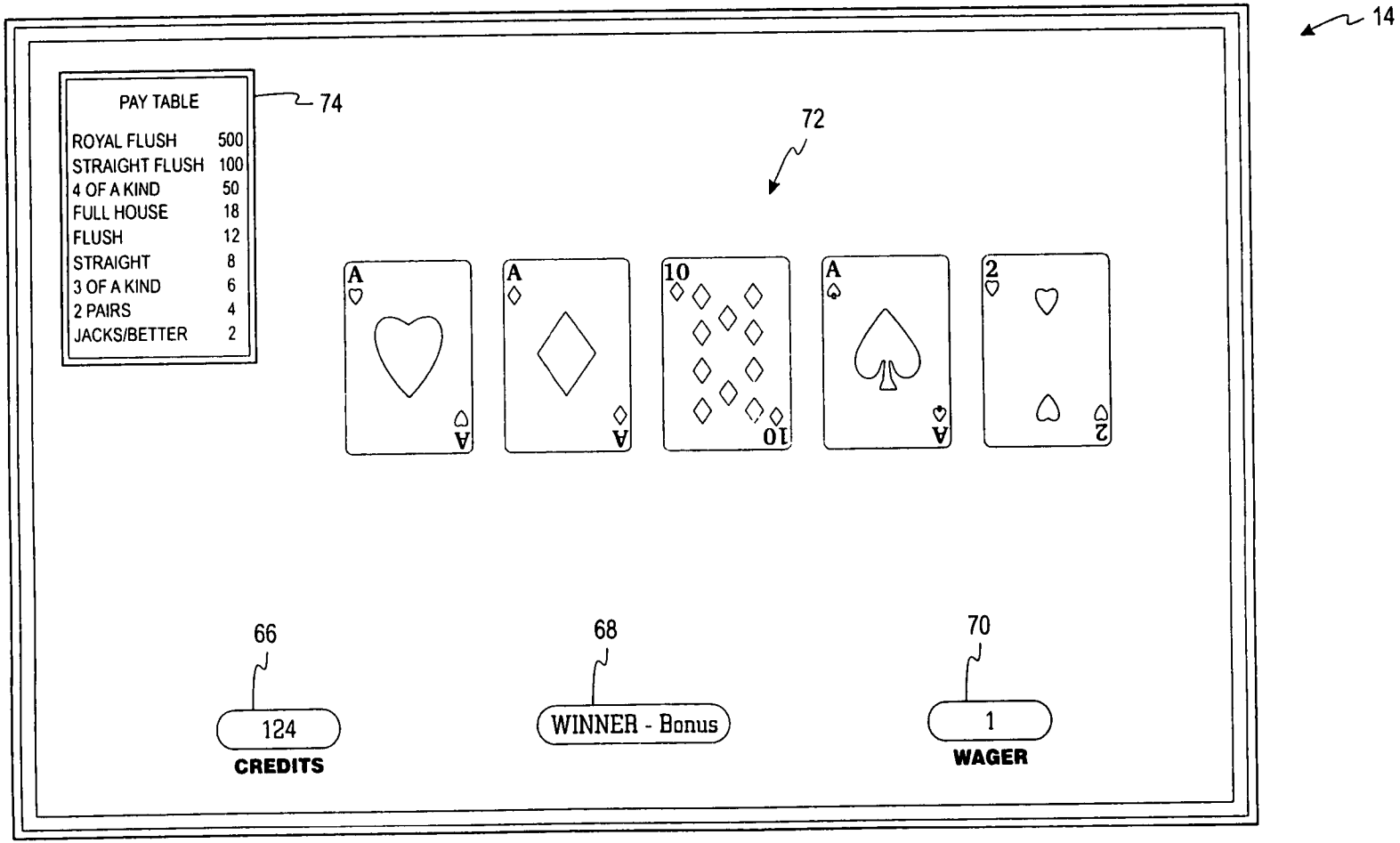
FIG. 4 is a subsequent screen of the primary display of the gaming machine of FIG. 1.

When a player achieves the qualifying hand, the player is awarded a bonus hand. The bonus hand may be a free hand or it may be a hand that the player still must place a wager on. The bonus hand, however, has a special feature. Turning now to FIG. 4, one of the special features of the bonus hand will be described. In this embodiment, a second poker hand 72 is the bonus hand and the special feature is a modified pay table 74. The modified pay table 74 offers awards at twice the amount of the first pay table 64. In other words, a multiplier (2×) is applied to the awards of the first pay table 64. As shown in the credit meter 66 and wager indicator 70, the one credit wager is still deducted for the second poker hand 72. In other embodiments, the second poker hand 72 may be free and credits may not be deducted for the hand.

Figure 5:
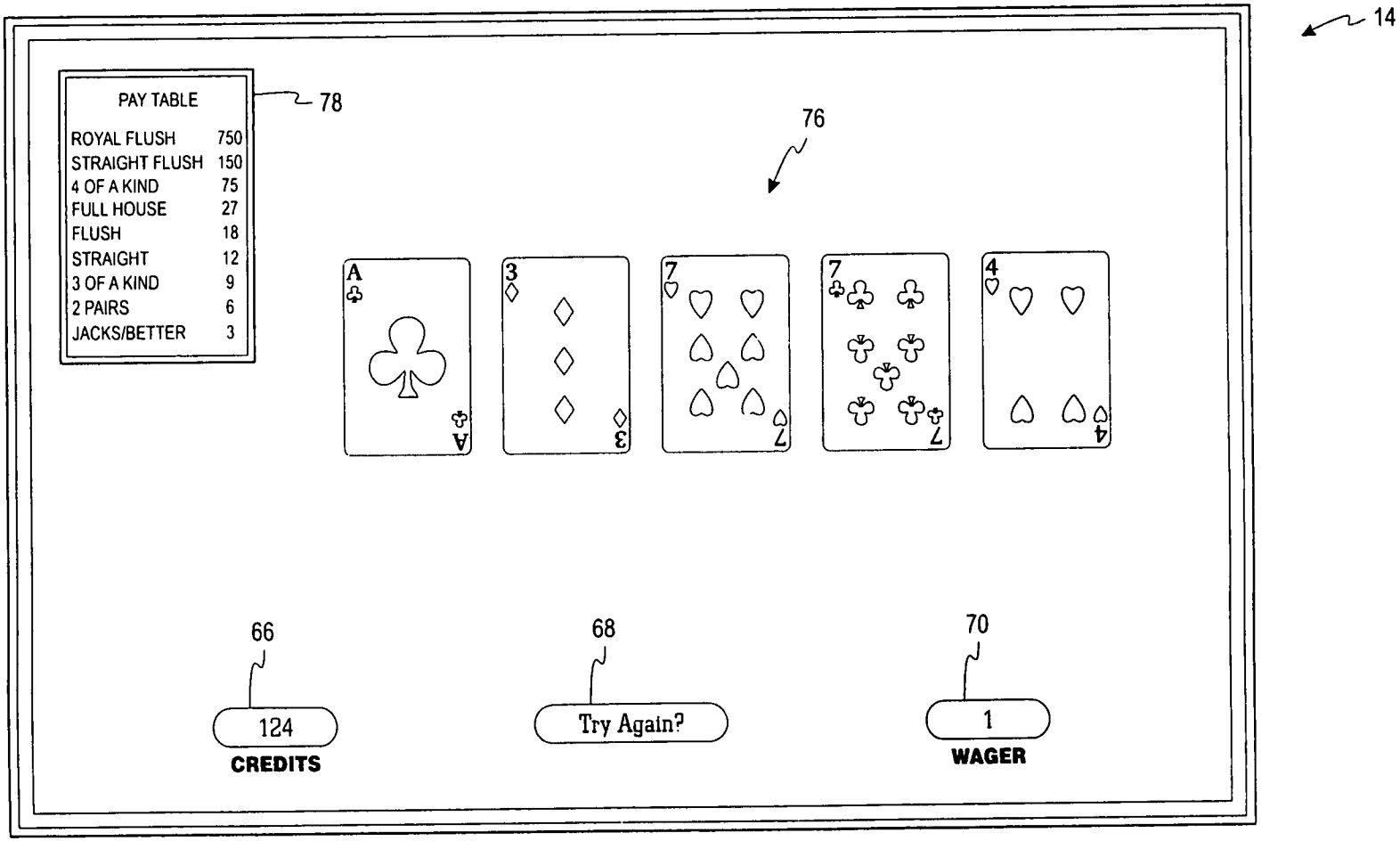
FIG. 5 is another subsequent screen of the primary display of the gaming machine of FIG. 1.

As shown, the second poker hand 72 is also a winning hand, having three aces. The player is awarded 6 credits in accordance with the modified pay table 74. In this embodiment, the pay tables continue to increase until the player has a losing hand. In other words, once the player achieves the qualifying hand, any other winning hand increases the pay table. In this example, because the second poker hand 72 is a winning hand, the player is awarded another bonus hand, i.e., a third poker hand 76. As shown in FIG. 5, another modified pay table 78 is provided. The second modified pay table 78 is increased by a second multiplier (3×) relative to the first pay table 64 in FIG. 3. The third poker hand 76 is not a winning hand. At this point, the player is asked if she or he would like to play again.

In each of the illustrated poker hands 62, 72, 76, only the final hand has been shown. As stated above, it should be understood that for each of the three hands 62, 72, 76, the player is given the option to hold or be dealt new cards. The poker hands 62, 72, 76 show the final hand.

Figure 6:
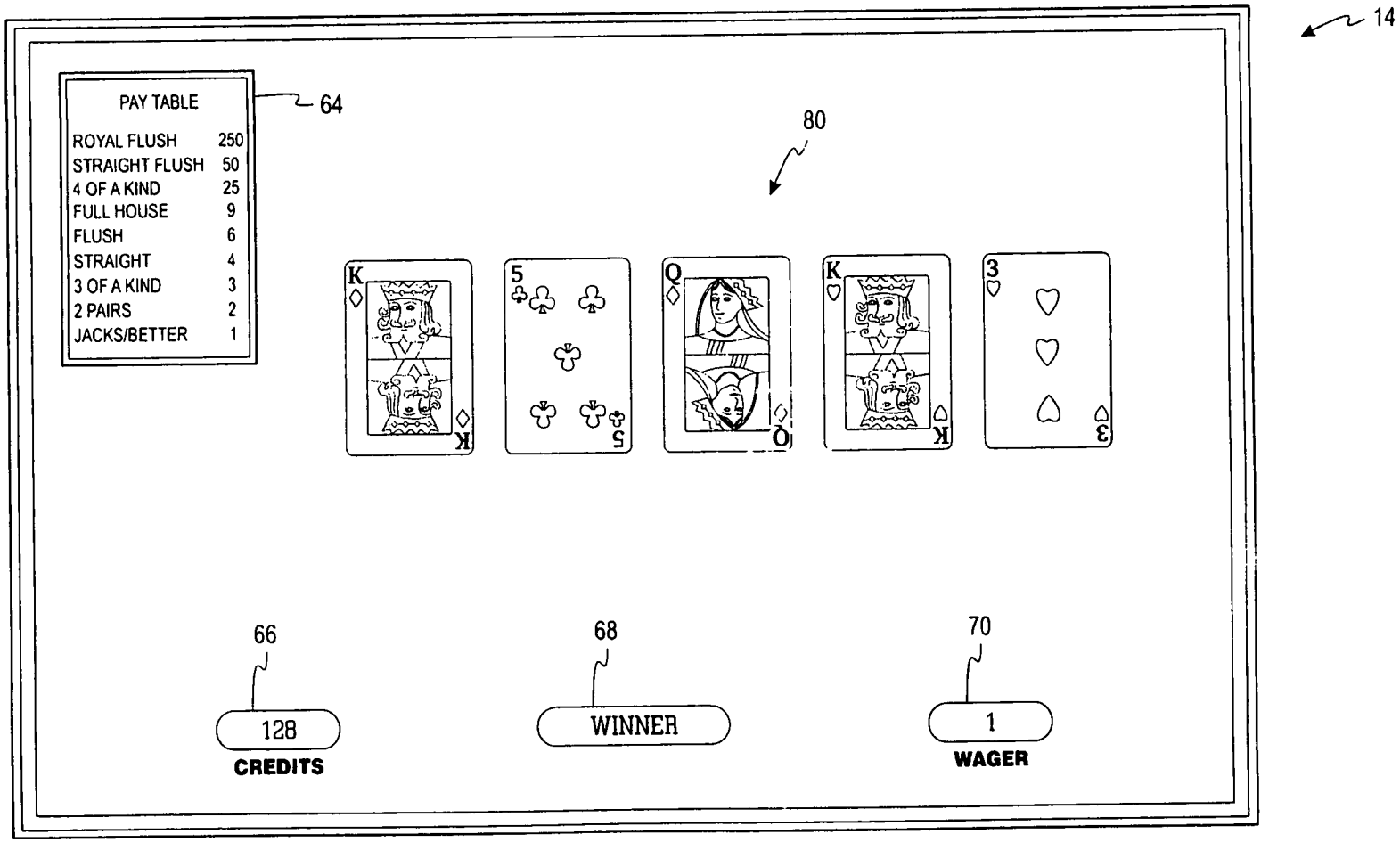
FIG. 6 is yet another subsequent screen of the primary display of the gaming machine of FIG. 1.

In this example, the player chooses to play again and is dealt a new hand 80 as shown in FIG. 6. The original pay table 64 is re-activated, and the player is awarded for achieving a winning hand. Because this hand 80 is not a qualifying hand (e.g., it does not include four-of-a-kind of higher), the pay table 64 will remain unchanged for the next hand.

FIGS. 3-6 describe one embodiment in which, after the qualifying hand is achieved, the pay table is increased in each subsequent winning hand. In other embodiments, the pay table may be increased once after the winning hand, and then may stay at that level until the player loses.

In another embodiment, the pay table may increase with each winning hand, as described above. However, unlike the embodiment above, instead of immediately returning to the first pay table, the pay table decreases with each losing hand, until the pay table returns to its original, un-modified setting. In other embodiments, once the qualifying hand is achieved, the pay table may remain increased for a set period of time or for a set number of hands.

Figure 7:
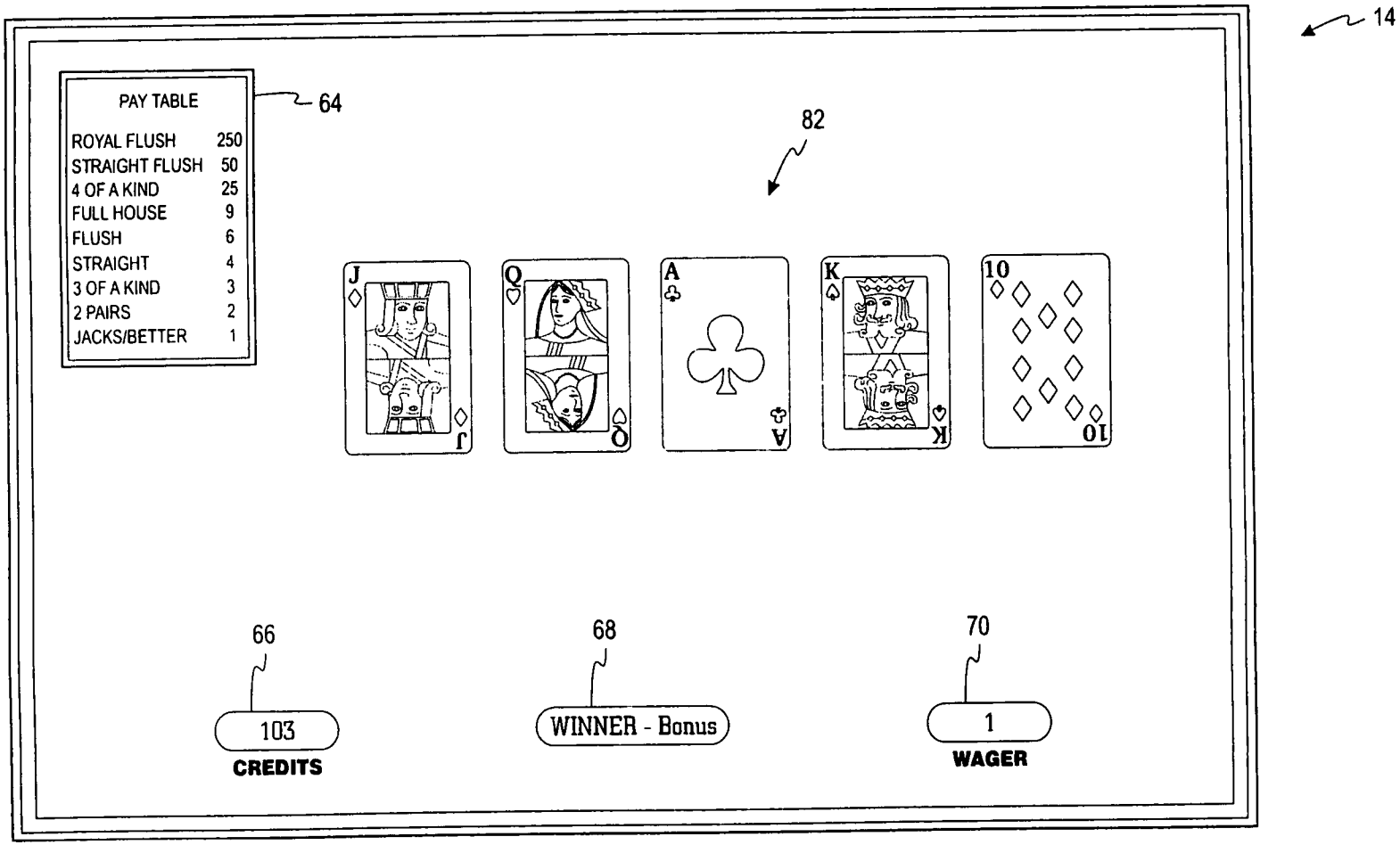
FIG. 7 is another screen of the primary display according to another embodiment of the gaming machine of FIG. 1.

Turning now to FIG. 7, another embodiment of the present invention will be described. In this embodiment, the player's first hand was the hand 62 shown in FIG. 3. Because the hand 62 was a qualifying hand, the player was dealt a second, bonus hand 86 shown in FIG. 7. The pay table 64 is unmodified. However, in this embodiment, the deck of cards is modified. The deck of cards used to create the second poker hand 86 is comprised of only cards equal to, or higher than, the cards achieving the qualifying hand (in this case tens). Enhancing the deck of cards increases the player's chances of winning credits in the second poker hand 86. In the illustrated embodiment, the player has three-of-a-kind and is awarded 3 credits in accordance with the posted pay table. As with the embodiments described above, the modified deck may last for a predetermined amount of times, a predetermined number of hands, or until the player achieves a losing hand.

In another embodiment, the achieving the qualifying hand may allow the player entry into a bonus game. The bonus game grants the player multiple extra hands that are shown all at once. For example, once the player achieves the qualifying hand, three free hands may be displayed on the gaming machine 14.

In yet another embodiment, the pay table may be selectively modified. The payout amounts for the various winning hands may not increase by the same multiplier, with the payouts of some of the winning hands increasing more than others. Alternatively, the payout amount of the qualifying hand may increase disproportionately with respect to the payout amounts of the other winning hands. In other embodiments, the payout amounts of any hand higher than the qualifying hand may increase more than the payout amounts of the other winning hands. In yet other embodiments, the increases in the payouts may be random. Alternatively, extra winning hands may be added to the pay table (such as a pair of tens).

In other embodiments, cards may be added to the deck. For example, four wild cards may be added to the deck after a qualifying hand is achieved, thereby increasing the player's odds of having a winning hand the next time. Alternatively, certain cards in the deck may be modified. For example, the cards that created the qualifying hand may all become "wild" cards in the next hand.

Each of these embodiments and obvious variations thereof is contemplated as falling within the spirit and scope of the claimed invention, which is set forth in the following claims.

What is claimed is:

1. A gaming machine for playing a card-based wagering game comprising:

a wager input device for receiving inputs from a player during the wagering game, the inputs including a wager amount; and at least one display for displaying a plurality of cards, the plurality of cards arranged in a hand, the hand indicating a randomly selected outcome selected from a plurality of outcomes, the plurality of outcomes including a qualifying-hand outcome corresponding to a qualifying hand and a plurality of winning outcomes corresponding to winning hands, the winning hands ranging from a lowest winning hand to a highest winning hand, wherein the qualifying hand is greater than the lowest winning hand, and the gaming machine, in response to the randomly selected outcome being the qualifying-hand outcome, awards a player a bonus hand.

2. The gaming machine of claim 1 wherein the bonus hand comprises a plurality of cards from a modified deck of cards.

3. The gaming machine of claim 2 wherein the qualifying hand includes a four-of-a-kind and the deck of cards only include cards equal to or higher than the four-of-a-kind.

4. The gaming machine of claim 1 wherein the gaming machine, in response to the randomly selected outcome being one of the plurality of winning outcomes, awarding the player an award based on a basic game pay table.

5. The gaming machine of claim 4 wherein the bonus hand has a randomly selected outcome, and the gaming machine, in response to the bonus-hand randomly selected outcome being one of a plurality of bonus winning outcomes, awarding the player an award based on a modified pay table.

6. The gaming machine of claim 5 wherein the awards in the modified pay table are generated by applying a multiplier to the awards of the basic game pay table.

7. A method of conducting a card-based wagering game on a gaming system, the method comprising:

receiving a monetary wager via a wager-input device associated with the gaming system;

converting the monetary wager into an opportunity for a player to play the wagering game on the gaming system;

initiating the wagering game on the gaming system;

generating a random number via a random-number generator configured to output random numbers;

correlating the random number output by the random-number generator to a wagering-game outcome via a processor;

displaying a representation of dealing a player a poker hand on a display, the poker hand including a plurality of winning hands ranging from a lowest winning hand to a highest winning hand and a qualifying hand being greater than the lowest winning hand;

in response to the poker hand being one of the plurality of winning hands, awarding the player an award amount; and in response to the poker hand being the qualifying hand, the gaming system awarding the player at least one bonus hand.

8. The method of claim 7 wherein the card-based wagering game comprises a pay table listing a plurality of awards, and the awarding the player the award amount comprises awarding the player a corresponding one of the plurality of awards from the pay table.

9. The method of claim 8 wherein, in response to the player's hand being the qualifying hand, further comprising modifying the pay table for the bonus hand.

10. The method of claim 9 wherein the modified pay table lasts for a predetermined number of hands.

11. The method of claim 9 wherein the modified pay table lasts for a predetermined period of time.

12. The method of claim 9 wherein the modified pay table lasts until the at least one bonus hand is a non-winning hand.

13. The method of claim 9 wherein the modifying comprises applying a multiplier to at least some of the plurality of awards in the pay table.

14. The method of claim 13 further comprising increasing the multiplier for a subsequent hand if the at least one bonus hand is a winning hand.

15. The method of claim 14 wherein the increasing the multiplier continues until the subsequent hand is a non-winning hand.

16. The method of claim 13 further comprising decreasing the multiplier for a subsequent hand if the at least one bonus hand is a losing hand.

17. A method of playing a card-based wagering game on a gaming system, the method comprising:

receiving a wager to play the card-based wagering game on a wager-input device associated with the gaming system, the wagering game including a plurality of winning outcomes, the plurality of winning outcomes including a lowest winning outcome and a qualifying outcome, the qualifying outcome being different from the lowest winning outcome;

converting the monetary wager into an opportunity for a player to play the wagering game on the gaming system;

initiating the wagering game on the gaming system;

generating a random number using a random-number generator configured to output random numbers;

correlating the random number output by the random-number generator to a first wagering-game outcome via a processor;

displaying the first wagering-game outcome on a display;

the gaming system awarding a player an award in response to the first wagering-game outcome being one of the plurality of winning outcomes; and displaying a second randomly selected wagering-game outcome in response to the first wagering-game outcome being the qualifying outcome on the display.

18. A computer readable storage medium encoded with instructions for directing a gaming device to perform the method of claim 17.

19. The method of claim 17 wherein the awarding a player an award in response to the first wagering-game outcome being one of the plurality of winning outcomes is performed by a controller.

20. The method of claim 19 wherein the controller is external to the gaming machine.

* * * * *